United States Patent [19]

Jones

[11] 4,326,936

[45] Apr. 27, 1982

[54] REPEATABLE METHOD FOR SLOPING WALLS OF THIN FILM MATERIAL

[75] Inventor: Addison B. Jones, Yorba Linda, Calif.

[73] Assignee: Rockwell International Corporation, El Segundo, Calif.

[21] Appl. No.: 195,957

[22] Filed: Oct. 14, 1980

[51] Int. Cl.[3] ..... C23C 15/00

[52] U.S. Cl. ..... 204/192 E; 156/643

[58] Field of Search ..... 204/192 E; 156/643, 156/654–657, 659.1

[56] References Cited

U.S. PATENT DOCUMENTS 4,092,210 5/1978 Hoepfner ..... 156/643
4,119,881 10/1978 Calderon ..... 313/360

OTHER PUBLICATIONS

M. Cantagrei, "Comparison of the Properties of Different Materials Used as Masks for Ion-Beam Etching", *J. Vac. Sci. Technol.,* vol. 12, pp. 1340–1343 (1975).

L. Mader et al., "Ion Beam Etching of Silicon Dioxide on Silicon," *J. Electrochem. Soc.,* vol. 123, pp. 1893–1898 (1976).

J. E. Hitchner et al. "Polyimide Layers Having Tapered via Holes", *IBM Tech. Disc. Bull.,* vol. 20, p. 1384 (1977).

J. A. Bondur et al., "Step Coverage Process with Projection Printing & Reactive Ion Etching," *IBM Tech. Disc. Bull.,* vol. 19, pp. 3415–3416 (1977).

P. G. Glöersen, "Ion-Beam Etching", *J. Vac. Sci. Technol.,* vol. 12, pp. 28–35 (1975).

*Primary Examiner*—Aaron Weisstuch

*Attorney, Agent, or Firm*—H. Fredrick Hamann; Wilfred G. Caldwell

[57] ABSTRACT

The invention is a method of sloping thin film materials so that smooth, continuous films may be deposited thereon. By controlling the thickness of resist mask over the materials (as for patterning) relative to ion milling or sputter etching parameters, repeatable slopes and linewidths may be achieved. For use in bubble memory fabrication, the sloping of conductor walls enables propagation bars to be laid down in crossing over relation thereto while enhancing yield.

1 Claim, 11 Drawing Figures

REPEATABLE METHOD FOR SLOPING WALLS OF THIN FILM MATERIAL

The invention herein described was made in the course of or under a contract or subcontract thereunder, with the Department of the Army.

FIELD OF THE INVENTION

The invention relates to the method of patterning conductors or other materials which are thin film material appearing on a substrate so that lateral pattern dimensions are accurately and reproducibly achieved, and so that the edges of the thin film pattern are sloped to provide continuous step coverage for subsequently deposited thin film layers. This technique is useful in fabricating microcircuitry, and particularly in manufacture of silicon integrated circuits and bubble memory devices.

BACKGROUND ART

The closest known prior art is U.S. Pat. No. 3,904,462 to Dimigen et al. This patent utilizes a mask of titanium or aluminum oxide to produce an etched structure having an inclined etch profile. The etching may be carried out to depths of one micrometer and more by adjusting one of the layer thickness of the mask and the angle of incidence of the ion beam so as to etch to the desired depth. However it is noted that the angle of etching conforms exactly to the angle of taper of the mask and the mask is of a material substantially immune to ion etching or removal. The problem is thus transferred to production of a dimensionally accurate mask with repeatably sloped walls. This requires several processing steps in addition to the standad lithography and etching procedures.

BRIEF DESCRIPTION OF THE INVENTION

The invention is a method of sloping walls of a thin film material on a substrate which comprises laying down a resist of known material and thickness over the thin film material, patterning the resist by a known lithography technique, and ion bombarding the patterned resist and thin film material to etch the resist and thin film material. During ion etching, the resist pattern acquires sloping walls, and by choosing the proper resist thickness, sloped walls are produced in the pattern etched in the thin film material.

BRIEF DESCRIPTION OF THE PREFERRED EMBODIMENT

By way of example, in two-level bubble circuit processing, it is important to produce sloped walls on the conductor lines in order that the subsequent thin-film layers will be free of discontinuities which would occur if the underlined conductor lines had vertical or near-vertical edges. Current techniques employ such near-vertical edges which account in some major part for low yield in multiple layer devices.

The prior art has utilized thin film deposition techniques such as evaporation or sputtering which in varying degree yield poor step coverage. The availability of sloped conductor walls, by virtue of the present invention, enables good step coverage utilizing standard deposition techniques.

Figure 1:
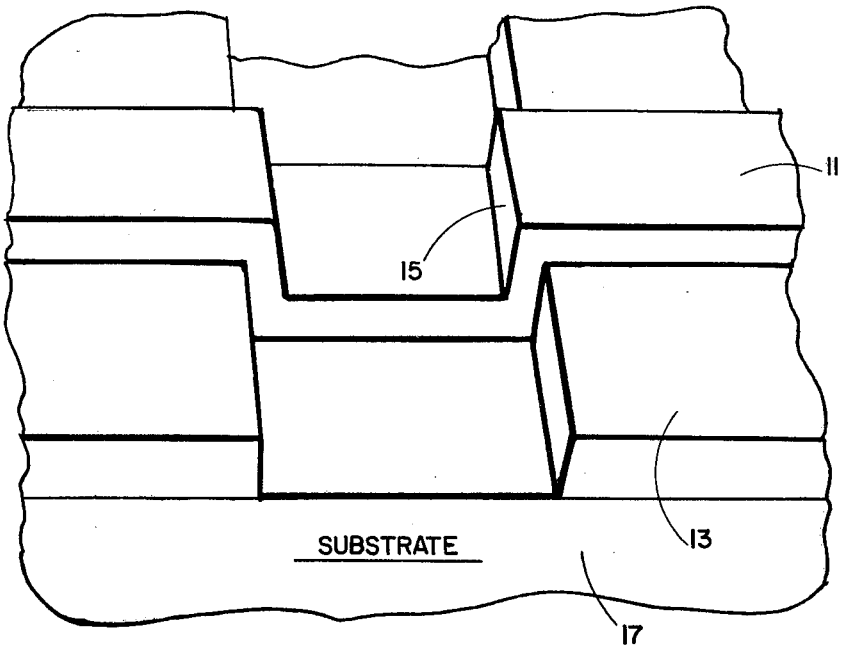
FIG. 1 PRIOR ART
FIG. 1 is an example of a prior art arrangement of a bubble memory propagation bar extending over a conductor.

In FIG. 1, the prior art shown is typified by a bubble memory propagation bar 11 passing over a conductor 13 in a thin film arrangement carried by substrate 17. The thickness, continuity, and uniformity of wall 15 of propagation bar 11 are frequently inadequate for proper circuit operation due to poor step coverage of vertical surfaces by the deposition method used to produce the thin film from which bar 11 is formed. This is especially true if bar 11 must carry electrical current. Local joule heating and electromigration often cause failure at this point.

It is ever the object of design engineers to extend the range or density of thin film circuitry, and accoringly such weak points manifest themselves with increasing alarm because device fabrication yield is highly susceptible to slight variation in surface conditions, resist properties, humidity, conductor grain size and many other factors.

Another frailty is the fact that that conductor should scale as the dimensions of bubble circuits or other thin film circuits are reduced.

Accordingly, the present method reliably defines sloped conductor walls using ion-beam milling or sputter etching. The significant parameters in ion beam milling are milling voltage, beam current, etching time and resist thickness, all of which are easily controlled so that a predetermined slope may be developed in the conductor lines during the patterning step.

It is significant to note that: given constants for all parameters except resist thickness, it is possible to control the wall slope angle of the material to be patterned, by altering the resist thickness. However, the preferred approach utilizes control of all parameters to achieve a given or predetermined slope. It should also be noted that for given or constant parameters, it is possible to empirically determine the resist thickness required for developing a given wall profile, simply by observing through a high power microscope or scanning electron microscope when the etching has proceeded sufficiently to provide the given slope.

Figure 2:
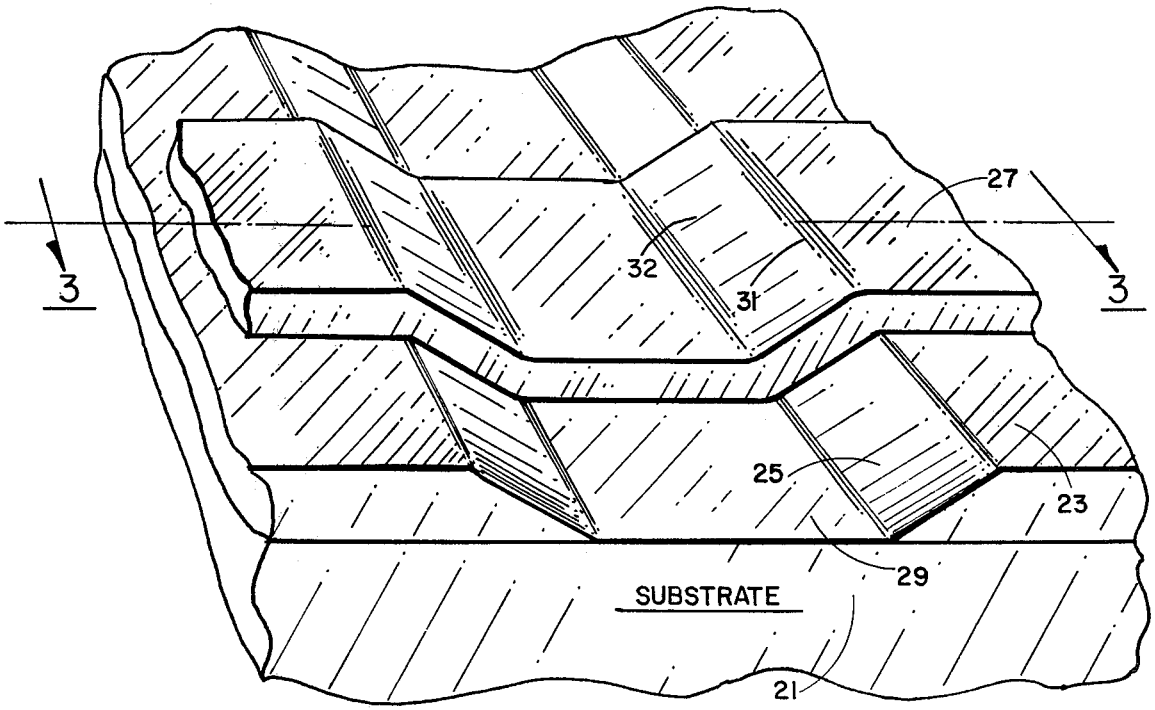
FIG. 2 shows, in perspective, a view of a bubble memory propagation bar extending over a conductor in accordance with the present invention.

In FIG. 2, a substrate is pictured at 21 having a conductor 23 with sloped wall 25 making an angle to the substrate which may be predetermined, and another element, such as a permalloy propagation bar 27 overlying the conductor 23. In working down to one micron or sub-micron dimensions, it is preferable that the slope angle between wall 25 and the horizontal surface 29 of substrate 21 be within the range of 30 to 60 degrees. This is sufficient to provide uniform, continuous step coverage, 32, for most standard thin film deposition techniques and to round the edge 31 of the propagation bar 27 as it passes over conductor 23 to avoid the weaknesses of the prior art.

Figure 3:
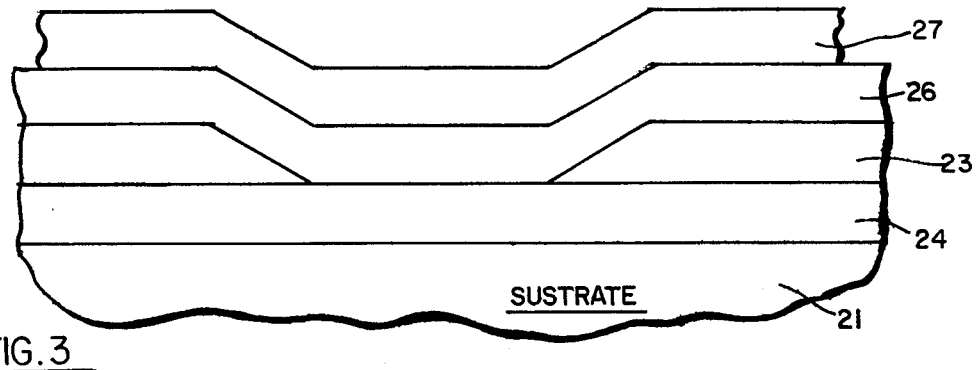
FIG. 3 is an enlarged view in cross-section of the structure of FIG. 2 to show the insulating layers.

In FIG. 3, a section of the thin film structure is shown enlarged to reveal insulator layers 24 and 26. Layer 24 covers the substrate 21 and layer 26 covers the conductors 23. These films may be comprised of silicon dioxide, for example.

Figure 4:
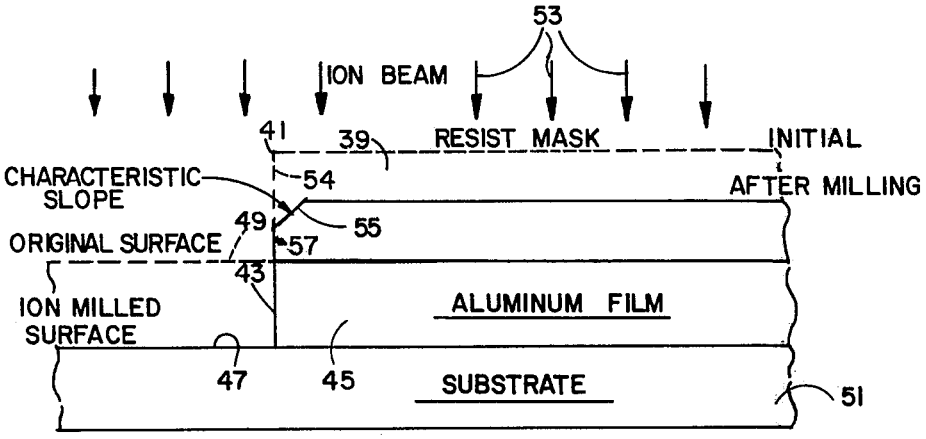
FIG. 4 is a schematic view in side elevation of a resist covering an aluminum film with an ion beam applied from the top and having been effective sufficiently in milling the left hand upper corners of the resist to the characteristic slope therefor.

In FIG. 4, a typical resist (Shipley AZ1350J) and thin film (aluminum or dilute aluminum-copper alloy) profile, after ion-milling at normal incidence designed to produce a pattern with vertical edges in the aluminum film, is shown. The original resist mask is illustrated at 39 havig a left hand corner 41 produced by ion-milling which developed the aluminum edge 43 of conductor 45 and the surface 47 which had been the aluminum conductor 45 upper surface 49, now corresponding to the upper surface of substrate 51. The ion beam is represented by the arrows, such as shown at 53, and it is preferably a uniform beam. The aluminum film 45 beneath the resist mask 39 is protected from ion bombardment.

As ion beam etching proceeds, the entire corner 41 is eroded away and the resist assumes its characteristic slope, shown at 55. This slope is characteristic for the particular resist material milled, the ion mass and the ion energy. However, extended milling will cause the characteristic slope to eventually reach the aluminum film 45, and further milling will cause the aluminum film to develop the slope desired, as will be described subsequently.

Thus, in FIG. 4 the un-masked aluminum surface 49 is eroded, as is the masking resist at corner 41. But, so long as the milling is terminated prior to the intersection of the characteristic slope 55 with the upper aluminum surface of conductor 45, a vertical wall 43 remains in the aluminum film 45 and the resist 39 has some vertical wall remaining, as shown at 57.

The characteristic slope 55 is produced because ion-milling may be likened to sand blasting or a billiard game between ions and atoms, i.e. it is a momentum-transfer process, and momentum is much more readily transferred in a forward direction. Thus, an accelerated ion hitting a surface a glancing blow may remove twice as many atoms from the surface as one hitting the surface head-on. This yield dependence (atoms removed per incident ion) is counter balanced by the drop-off of beam current per unit area of surface, which varies as the cosine of the incidence angle.

Figure 5:
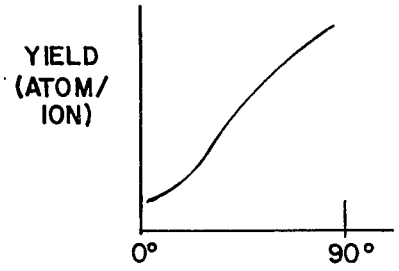
FIG. 5 is a chart of yield of atoms per ion impinging upon thin film material from various angles between 0° and almost 90°, the angle being measured between beam direction and surface normal.

In FIG. 5 the yield of atoms per ion is plotted against the incidence angle, and it may be seen that as this angle approaches 90 degrees, the yield is much higher than for a normal incidence.

Figure 6:
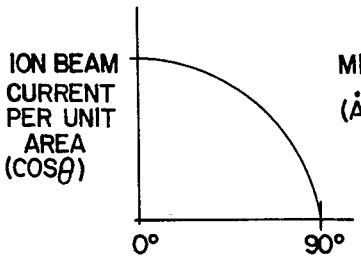
FIG. 6 is a chart of ion beam current inpinging per unit area, i.e. (beam current x cos $\theta$) where $\theta$ is the angle between the beam direction and surface normal.

In FIG. 6, the ion beam current per unit area (cosine $\theta$) is plotted against the incidence angle and of course falls off as an incidence angle of 90 degrees is approached.

Figure 7:
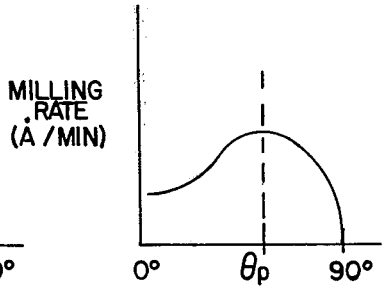
FIG. 7 is a chart showing milling rate in angstroms per minute versus incident angle with the maximum milling rate being indicated by $\theta_p$.

The product of these two curves is a milling-rate curve, illustrated in FIG. 7, wherein the angle $\theta_p$, at which the maximum milling-rate occurs, is the angle at which the characteristic slope will develop, and varies as a function of the material being milled and bombarding ion mass and energy.

Now, if normal incidence ion beam etching continues beyond the stage shown in FIG. 4, the characteristic slope 55 of the resist 39 will intersect the aluminum surface 49 at a time when $$t_m = \frac{Xaz}{R_{\theta p}^{AZ}} \operatorname{Cos}\theta_p^{AZ} \qquad (1)$$

wherein: $t_m$ = milling time in minutes at which the profile in the thin film starts to depart from vertical; $X_{AZ}$ = the thickness of resist mask (AZ1350J) in angstroms; $\operatorname{Cos}\theta_p^{Az}$ = Cos of the peak milling-rate angle for AZ1350J; $R_{\theta p}^{AZ}$ = peak milling rate of AZ1350J in Å/min; and, AZ1350J = a positive resist material, commercially available from Shipley.

R. F. sputter etching may be substituted for normal incidence ion beam milling.

Figure 8:
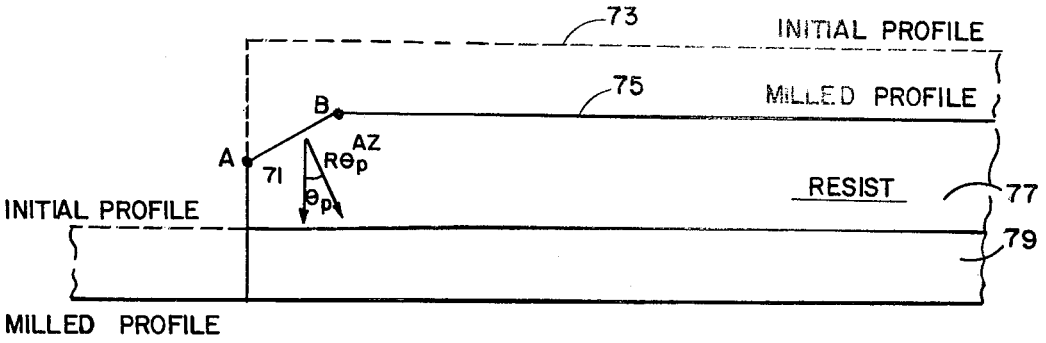
FIG. 8 is a schematic side elevational view of the resist and aluminum to show the definition of certain parameters.
Figure 9:
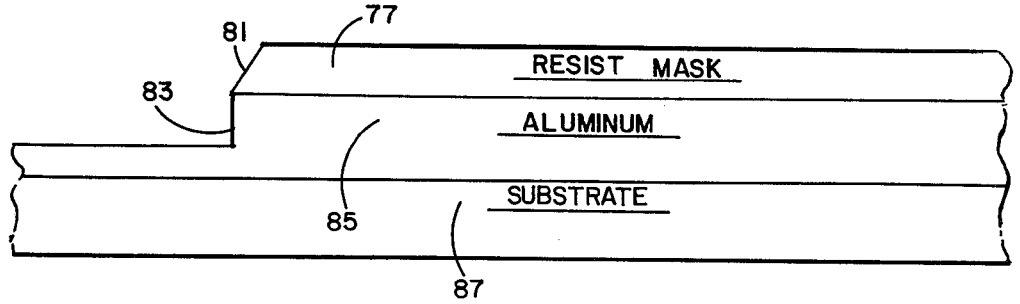
FIG. 9 shows the resist over the aluminum over the substrate after milling to the point that the resist has been sloped to reach the thin metal material, e.g., aluminum covered thereby.

Referring now to FIGS. 8 and 9; at the end of time $t_m$, the milled profile appears as in FIG. 9 with the angle of faceting shown by $\theta$p in FIG. 8 at 71 with the vertical milling rate at A being $$R_{\theta p}^{AZ}/\operatorname{Cos}\theta_p^{AZ}.$$

The initial profile is the upper line shown at 73, the milled profile being the resist upper surface 75 for resist 77 over thin film aluminum 79.

Thus, in FIG. 9 the resist mask 77 has a slope 81 extending down to the vertical wall 83 of the aluminum conductor 85, carried by substrate 87.

Figure 10:
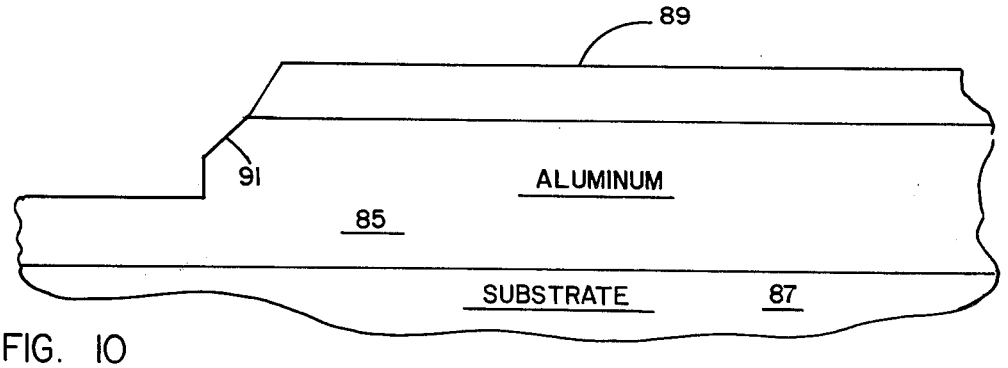
FIG. 10 shows the same structure following additional milling wherein the aluminum has become partially sloped; and, FIG. 11 shows a portion of the finished product wherein the desired degree of sloping has been attained at the edge of an aluminum conductor.

Further milling of the aluminum (or aluminum copper) 87 using an AZ1350J resist mask 89, as shown in FIG. 10 yields the profile of milled slope 91 for aluminum conductor 87.

Figure 11:
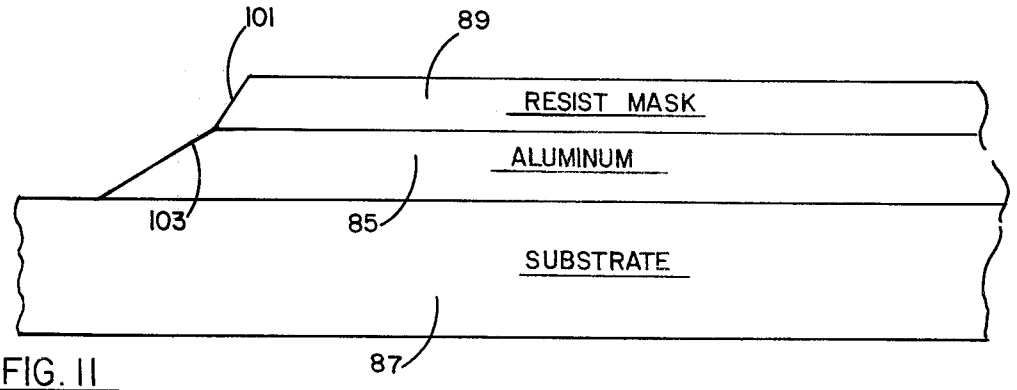

Finally, if milling proceeds until the vertical step is eliminated but before narrowing of the base dimension of the conductor line begins, the profile shown in FIG. 11 indicates the differential milling-rate because the slope 101 of the resist material 89 is considerbly different than the slope 103 of the aluminum or aluminum-copper material 87.

The desired time for milling is:

$$t_f = t_m + \frac{Xal}{R_{\theta p}^{ac}} \operatorname{Cos}\theta_p^{Al} \qquad (2)$$

wherein : $t_f$ = milling time in minutes for the aluminum (or aluminum-copper) to clear from the unmarked protion of the wafer; $t_m$ is defined in EQ. (1); $X_{Al}$ = Aluminum thickness in Å, $R_{\theta p}^{Al}$ = milling rate at peak milling rate angle for aluminum in Å/min; $\operatorname{Cos}\theta_p^{Al}$ —cosine of the aluminum peak milling rate angle.

We also know that $$T_f = X_{Al}/R_{0°}\text{Al} \quad (3)$$

Wherein: $t_f$nd $X_{Al}$ are defined in Eq 2; and $R_{0°}{}^{Al}$ = milling rate of aluminum at normal incidence ($\theta$=o°) Combining Eq. 1, 2, and 3one obtains for the desired resist thickness to achieve the wall profile of FIG. 11;

$$X_{AZ} = X_{Al}\left(\frac{1}{R_{0°}Al} - \frac{\cos\theta_p^{Al}}{R_{\theta p}Al}\right)\frac{R\theta_p^{Az}}{\cos\theta_p^{Az}} \quad (4)$$

At 0.75 mA/cm$^2$ argon ion current at 600 eV with a normally incident beam the parameters of importance are:

$R_{\theta p}{}^{Az} = R_{60}{}^{Az} = 560$ Å/min; $R_{0}{}^{Az} = 330$ Å/min; Cos $\theta_p{}^{Az} = \cos 60° = 0.5$ $R_{\theta p}{}^{Al} = R_{40}{}^{Al} = 670$ Å/min; $R_{0}{}^{Al} = 400$ Å/min; Cos $\theta_p{}^{Al} = \cos 40° = 0.766$ Letting $X_{Al}$ = 4000 Å, from Eq. (3) we have $t_f$ = 10 minutes. Substituting into Eq. 4 from above:

$X_{Az}$=6078 Å resist for 4000-Å Aluminum

Notice that, in 10 minutes, only 3300 Å of this resist will be removed from the protected area away from the edges. If a thinner resist mask is used, line narrowing will result. If a thicker resist mask is used, milling time must be extended to eliminate the vertical step. This will also result in some line narrowing, due to the fact that part of the vertical step to be eliminated is now in the material underlying the aluminum.

Variation of ion energy, ion mass, and beam current affect the parameters utilized to arrive at the final result. The angle of slope as well as its speed of formation may be varied by modifying these parameters.

It is intended that the scope of the invention be limited only by the appended claims because various modifications may be made within the principles of the teaching herein set forth. For example the process is equally applicable to forming required slopes on a substrate or to sloping selected conductors or various numbers thereof. Materials other than conductors may also be shaped.

What is claimed is:

1. The method of sloping walls of a thin film material on a substrate, which sloping is repeatable for the same material, comprising the steps of:

laying down a metallization resist mask of known material and thickness over the thin film material;

patterning the resist;

impinging ions at normal incidence against the thin film material and resist to slope the resist walls toward the thin film material by removing resist material;

predetermining the time interval required to slope said resist to said thin film material and said thin film material to said substrate;

continuing the ion impingement until the desired slope of thin film material to substrate is attained; and, said predetermining of said time interval being determined in accordance with:

$$t_f = t_m + X\frac{\cos\theta_p}{R_{\theta p}} \text{ and } X = t_f R_{0°}$$

where $t_f$=milling time in minutes

X=thickness of thin film material in Å cos $\theta_p$=cosine of the peak milling rate angle for the thin film material $R_{\theta p}$=the milling rate at peak milling rate angle for the thin film material in Å/min $$t_m = X_r\frac{\cos\theta_p{}^r}{R^r_{\theta p}}$$

$X_r$=thickness of resist mask in Å cos $\theta_p{}^r$—cosine of the peak milling rate angle for the resist material $R_{\theta p}{}^r$=the milling rate in Å/min. at peak milling rate angle for the resist material.

* * * * *